US006211459B1

(12) United States Patent
O'Groske et al.

(10) Patent No.: US 6,211,459 B1
(45) Date of Patent: Apr. 3, 2001

(54) SHIELDED BULK CABLE

(75) Inventors: Rolland D. O'Groske; Keith F. Tharp; Sandy J. Shirk/Heath; Paul W. Schaefer; Scott M. Thorvilson; Michael K. Brown, all of Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 08/443,217

(22) Filed: May 17, 1995

(51) Int. Cl.[7] ..... H01B 11/18
(52) U.S. Cl. ..... 174/36
(58) Field of Search ..... 174/36, 102 R, 174/106 R, 113 R

(56) References Cited

U.S. PATENT DOCUMENTS

| | | | | |
|---|---|---|---|---|
| 3,576,387 | | 4/1971 | Derby | 174/36 |
| 3,888,088 | * | 6/1975 | Jarger | 61/72.3 X |
| 4,130,450 | * | 12/1978 | Bahder et al. | 156/48 X |
| 4,161,704 | * | 7/1979 | Schafer | 333/33 X |
| 4,371,745 | | 2/1983 | Sakashita | 174/115 |
| 4,506,235 | | 3/1985 | Mayer | 333/12 |
| 4,773,976 | * | 9/1988 | Vexler | 204/28 X |
| 5,171,937 | | 12/1992 | Aldissi | 174/36 |
| 5,206,459 | * | 4/1993 | Aldissi | 174/36 |
| 5,300,733 | * | 4/1994 | Uematsu | 174/106 SC X |
| 5,313,017 | | 5/1994 | Aldissi | 174/36 |
| 5,477,011 | * | 12/1995 | Singles et al. | 174/102 R |
| 5,521,331 | * | 5/1996 | Hillburn | 174/36 |
| 5,521,333 | * | 5/1996 | Kobayashi et al. | 174/113 R |

* cited by examiner

*Primary Examiner*—Kristine Kincaid
*Assistant Examiner*—Chau N. Nguyen
(74) *Attorney, Agent, or Firm*—Felsman, Bradley, Vaden, Gunter & Dillon, LLP

(57) ABSTRACT

A shielded bulk cable having a plurality of insulated conductors in a seamless covering. The seamless covering surrounds the plurality of insulated conductors and forms a seamless electromagnetic shield and electric insulator. The seamless covering has a conductive layer and an insulating layer. The conductive layer is bonded to the insulating layer and has a thickness substantially less than that of the insulating layer.

2 Claims, 2 Drawing Sheets

SHIELDED BULK CABLE

BACKGROUND OF THE INVENTION

1. Technical Field

The present invention relates to electromagnetic radiation shielding for bulk cable.

2. Description of the Related Art

It has long been known to coat current carrying cables with an insulative material to isolate electric current from the environment. For example, such insulation protects undesirable shorting or grounding of the wire cable. Where it is desired to have an electrical connection, the insulation can be stripped from the wire. While such coatings are effective as electric insulators, they are not effective as shields of electromagnetic energy.

Electronic equipment has been shielded by totally enclosing the equipment in a metal "container" or housing that is continuously conductive. The shielding of wires and cables has been accomplished in a similar manner by maintaining the wires and cables, with the electrically insulating coating, within metal pipes, the metal pipe providing the necessary shield. Such shields are extremely cumbersome since they are rigid and provide no flexibility to the system.

A more flexible shielding conduit can be made of woven metal braid, stripped metal formed into spiral bellows or some other spiral that allows interlocking of adjacent strips. Often times a foil layer is placed between the conductors and shield for a temperature barrier and shield enhancement.

The multiple steps and tedious process of weaving the braid makes this method for creating a shielded cable both cumbersome and expensive. Also, although such conduits are more flexible than metal pipes, they are not sufficiently flexible for many applications, and they suffer the additional disadvantage of providing inferior shields of electromagnetic energy due to the leakage of electromagnetic energy through the braids, joints, and other openings which are found in these types of conduits. This loss of shielding effectiveness increases as the frequency increases, and the shielding effectiveness is negligible at high frequencies In particular, it has been found that at frequencies in the range between 10 kHz to 10 GHz, and particularly at frequencies in the GHz region, with the aforementioned wire and cable type of shielding, it has not been possible to provide high attenuation characteristics, ie, at least 30 db, and preferable at least 40 to 60 db of attenuation, which is required in the art.

The goal of most shields is to provide as low an impedance path between both frame bodies on each end of the cable as possible. Optimally, a highly conductive, uniform shield material is desired. The braided shield provides shielded coverage proportional to the tightness of the braid. Thus, the tighter the braid, the higher the percent coverage of the shield. In terms of shielding ability of the cable, it is optimum to approach 100% coverage of the cable to maximize the shielding effectiveness. However, when shielding coverage by a braided cable reaches 90% and higher, the cable becomes much more rigid and inflexible. Cables using a foil wrapper help supplement braid. This increases the effective percent coverage. It is also difficult to maintain the integrity of a shield of high percent coverage braids over the life of the shield because of bending and movement of the cable. This causes separation of the braids and a degradation of shielding.

There are a number of problems associated with a metal/foil shield, however. First, on a cable assembly, it is usually a requirement that the braid make 360° contact with the connector or premold. Because the braid will unravel and break if not cut properly, special processes must be used to obtain 360° shielding at the connector. Second, complicated processes and expensive tooling are required to weave the small individual strands of wire that make up the metal braid over the cable. Third, due to the use of the metal braid and foil combination, cabling routing is limited in its achievable bend radius due to the metal braid and foil layers. Therefore, it would be desirable to provide a shielded bulk cable having 100% EMI and RFI shielding that does not require special processes to terminate at the connector, that doesn't require complicated processes and expensive tooling to manufacture, and that is more flexible than metal braid and foil cables to achieve greater bend radii.

SUMMARY OF THE INVENTION

According to the present invention, a shielded bulk cable is provided. A shielded bulk cable comprises a plurality of insulated conductors in a seamless covering. The seamless covering surrounds the plurality of insulated conductors and forms a seamless electromagnetic shield and electric insulator. The seamless covering has a conductive layer and an insulating layer. The conductive layer is bonded to the insulating layer and has a thickness substantially less than that of the insulating layer.

The above as well as additional objects, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
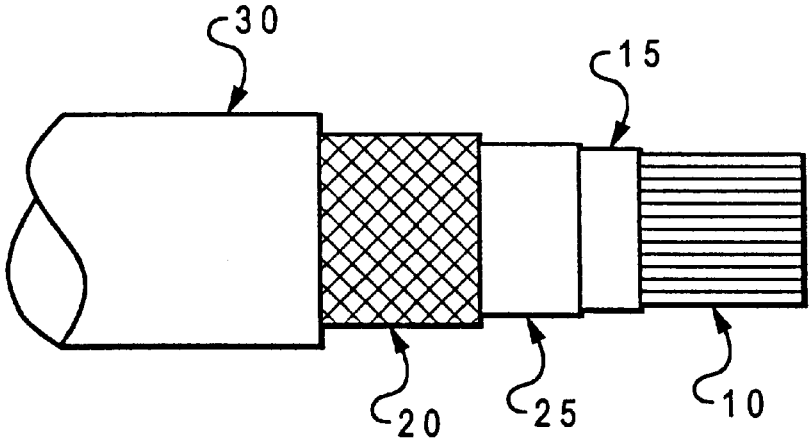
Fig. 1 Prior Art
FIG. 1 depicts a prior art bulk cable having a metal braid shield.

A prior art bulk cable having a metal braid shield is shown in FIG. 1. Multiple individually insulated conductors 10 are contained in a mylar wrapper 15 to maintain concentricity of the conductors 10. The electromagnetic compatible (EMC) shielding for the cable is provided by the combination of metal braid 20 and foil shield 25, both of which surround wrapper 15. The metal braid layer 20 is covered by the cable external jacket 30, which is a flexible and resilient polymeric material.

Metal braid 20 is often made from a tinned-copper braid surrounding the conductors 10. The metal braid 20 provides radio frequency (RF) shielding. However, to maintain cable flexibility, the metal braid has only about 85% coverage of the conductors 10 To obtain greater radio frequency interference (RFI) shielding, the mylar backed aluminum foil shield 25 underneath the metal braid layer 20 provides additional shielding from RFI and electromagnetic interference (EMI). With the two layers combined, a maximum shielding can be attained, while maintaining the required flexibility of the bulk cable.

Figure 2:
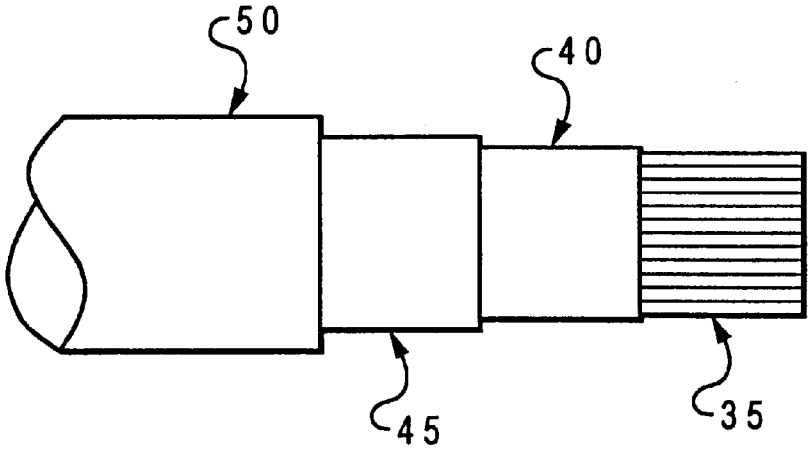
FIG. 2 shows a shielded bulk cable, in accordance with the preferred embodiment of the present invention.
Figure 3:
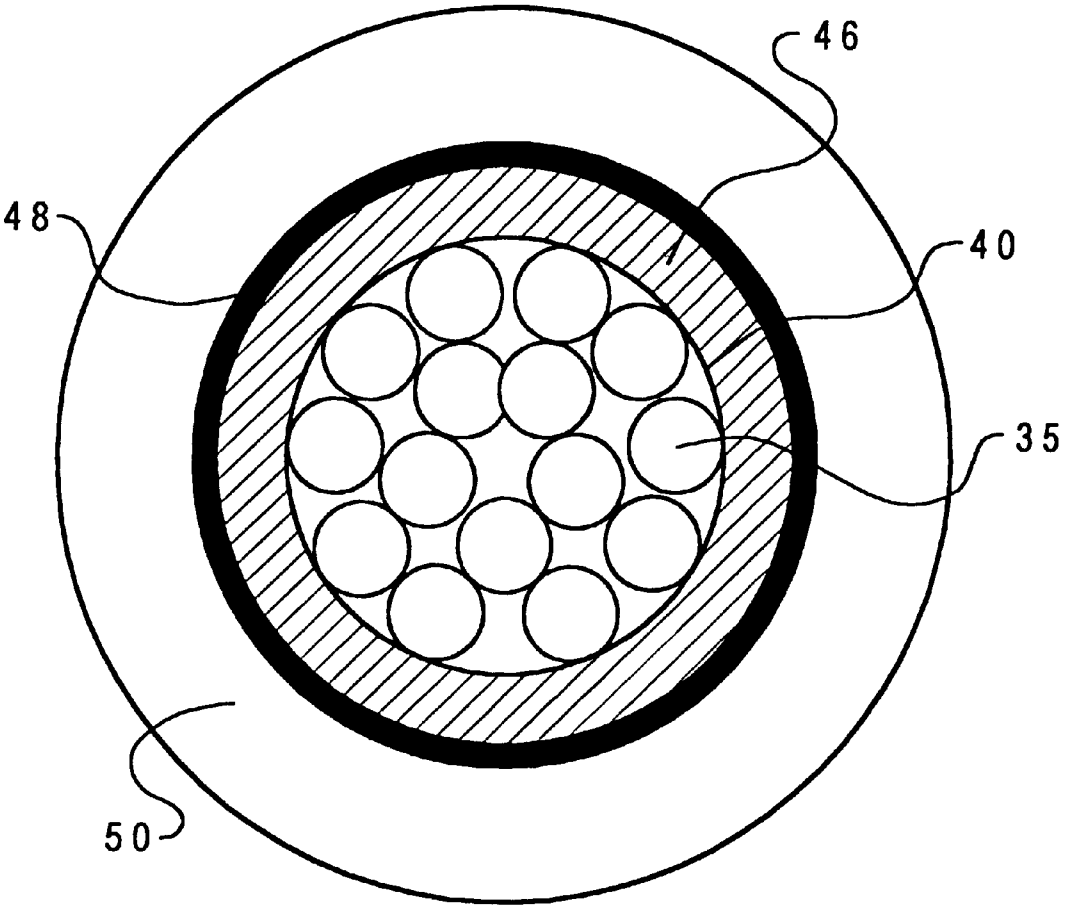
FIG. 3 shows a cross-sectional view of the shielded bulk cable of the present invention.

With reference now to FIG. 2, there is shown a shielded bulk cable, in accordance with a preferred embodiment of the present invention. Multiple individually insulated conductors 35 are at the center of the shielded bulk cable. In this invention, the bulk cable (conductors 35) is still built in the typical fashion. Conductors 35 are surrounded by a wrapper 40, made of mylar for example, to maintain concentricity of conductors 35. Surrounding wrapper 40 and conductors 35 is the covering 45. The covering 45 is comprised of an insulating layer 46 and a conductive layer 48, as seen in FIG. 3. The conductive layer 48 creates a seamless shield that surrounds conductors 35 to provide 100% EMI and RFI shielding. A cable external jacket 50 is made of resilient polymeric material and surrounds conductive covering 45.

Cable construction of the present invention can be achieved in many ways. A preferred method includes covering a discrete wire bundle 35 with an insulating layer 46 by extruding a layer of silicone. Over this, a conductive layer 48 made of silver and silicone rubber (can be very thin) is bonded or vulcanized to the much thicker insulating layer 46 of silicone rubber. Copper, nickel, or other highly conductive materials may replace the silver conductor. Conductive layer 48 may be extruded over the bulk wires so as not to limit the length of the cable.

In an alternative preferred method, an insulating layer 46 of polyvinylchloride (PVC) could be used with a conductive layer 48 laminated or bonded to the PVC insulating layer 48. The conductive layer is a metal layer made of nickel for example, that is sputter deposited onto the insulating PVC layer 46 to form a seamless coating of nickel that acts as an electromagnetic shield. The PVC material allows the cable to be a much more compliant member when connected to electronic assemblies while not compromising the shielding ability as the cable is bent and manipulated.

In another alternative preferred method, the metal conductive/PVC insulative layers 46, 48 are extruded over the bulk cable wires. The bulk cable may also be pulled through the shield layer as a method of construction. Either way, the cable is not limited in length by the construction method. In any method of construction a very thin, highly conductive layer provides 100% shielding coverage with a much thicker insulating layer attached for mechanical stability.

Because the covering 45 has a continuous conductive layer 48, connection of the covering to a connector or premold is easily achieved by use of conductive adhesive or 360° ferrule crimps. Thus, the shielded bulk cable of the present invention provides an easy way to attach the cable shield to connectors.

The invention utilizes a very thin electrically conductive layer applied to an insulative layer. This layer provides a uniform, highly conductive barrier for the electric shielding. The conductive layer may reside on either the inside or outside with respect to the bulk cable. Also, because the conductive layer is continuous over the entire cable, terminating the shielded at each end of the cable can be done much easier since there are no frayed ends of a braid material This makes it very easy to connect to frame grounds without shorting to signal grounds. Simpler means of mechanical fastening of the ends can also be used such as crimps instead of more complex soldering processes to provide complete electrical termination. Another advantage of proper material selection can be to utilize the outer insulation layer as a temperature barrier.

As will be appreciated by those skilled in the art, the shielded bulk cable of the present invention can be produced at a lower overall cost due to the elimination of a metal braid and the mylar backed aluminum foil. In addition, it will be appreciated that the replacement of the metal braid and foil shield with a conductive PVC covering will produce greater flexibility and a higher achievable bend radius of the shielded cable, enhancing cable routing possibilities. Most importantly, the shielded bulk cable of the present invention can be easily manufactured using extrusion processes, thereby eliminating the complicated and expensive tooling used to weave the metal braid.

While the invention has been particularly shown and described with reference to a preferred embodiment, it will be understood by those skilled in the art that various changes in form and detail may be made therein without departing from the spirit and scope of the invention.

What is claimed is:

1. A flexible shielded bulk cable, comprising:

a plurality of insulated conductors;

a flexible seamless covering surrounding the plurality of insulated conductors, said flexible seamless covering including an insulating layer and a conductive layer surrounding said insulating layer that forms a seamless electromagnetic shield, the conductive layer being bonded to the insulating layer and having a thickness substantially less than the thickness of the insulating layer, wherein the conductive layer is formed of a composition of silver and silicone; and an outermost jacket surrounding said conductive layer, wherein said conductive layer has an exterior surface and said outermost jacket has an interior surface, said interior surface of said outermost jacket being in contact with said exterior surface of said conductive layer.

2. A flexible shielded bulk cable according to claim 1, wherein the insulating layer is PVC.

* * * * *